United States Patent [19]

Edin et al.

[11] Patent Number: 5,064,074

[45] Date of Patent: Nov. 12, 1991

[54] ARRANGEMENT FOR DEPOSITING VALUABLE DOCUMENTS, SUCH AS BANK NOTES, CHEQUES

[75] Inventors: Gösta Edin, Rönninge; Hans Zettergren, Solna, both of Sweden

[73] Assignee: Inter Innovation AB, Stockholm, Sweden

[21] Appl. No.: 549,453

[22] Filed: Jul. 6, 1990

[30] Foreign Application Priority Data

Jul. 20, 1989 [SE] Sweden ..... 8902581

[51] Int. Cl.[5] ..... B07C 5/36

[52] U.S. Cl. ..... 209/534; 198/369; 209/900; 271/187; 271/302

[58] Field of Search ..... 209/534, 617, 900; 271/187, 315, 213, 300, 302; 198/368

[56] References Cited

U.S. PATENT DOCUMENTS

| | | | |
|---|---|---|---|
| 2,533,184 | 12/1950 | Trump | 271/302 |
| 4,759,447 | 7/1988 | Lundblad | 209/534 |
| 4,901,996 | 2/1990 | Schlough | 271/187 X |

FOREIGN PATENT DOCUMENTS

| | | | |
|---|---|---|---|
| 56807 | 7/1967 | Fed. Rep. of Germany | 271/302 |
| 136856 | 6/1986 | Japan | 271/213 |
| 210179 | 1/1967 | Sweden . | |

*Primary Examiner*—Donald T. Hajec

*Attorney, Agent, or Firm*—Simmons, Perrine, Albright & Ellwood

[57] ABSTRACT

An arrangement for depositing valuable documents includes provisions for feeding the documents through an opening via intermediate storage between two mutually coacting belts (13, 14) to another opening leading to a storage space (18) of the arrangement. A command device can be operated to control the function of the arrangement from an external location. The coacting belts (13, 14) are part of an intermediate storage device (131-141-20) which is pivotally mounted in a housing (16), allowing an infeed-and-outfeed opening (15) between the two coacting belts to be positionally adjusted to one of the openings, either in response to a command from the command device (34) or in response to a signal from a sensor (17) adjacent a document transport path in the proximity of the intermediate storage device (131-141-20).

5 Claims, 2 Drawing Sheets

Fig. 2
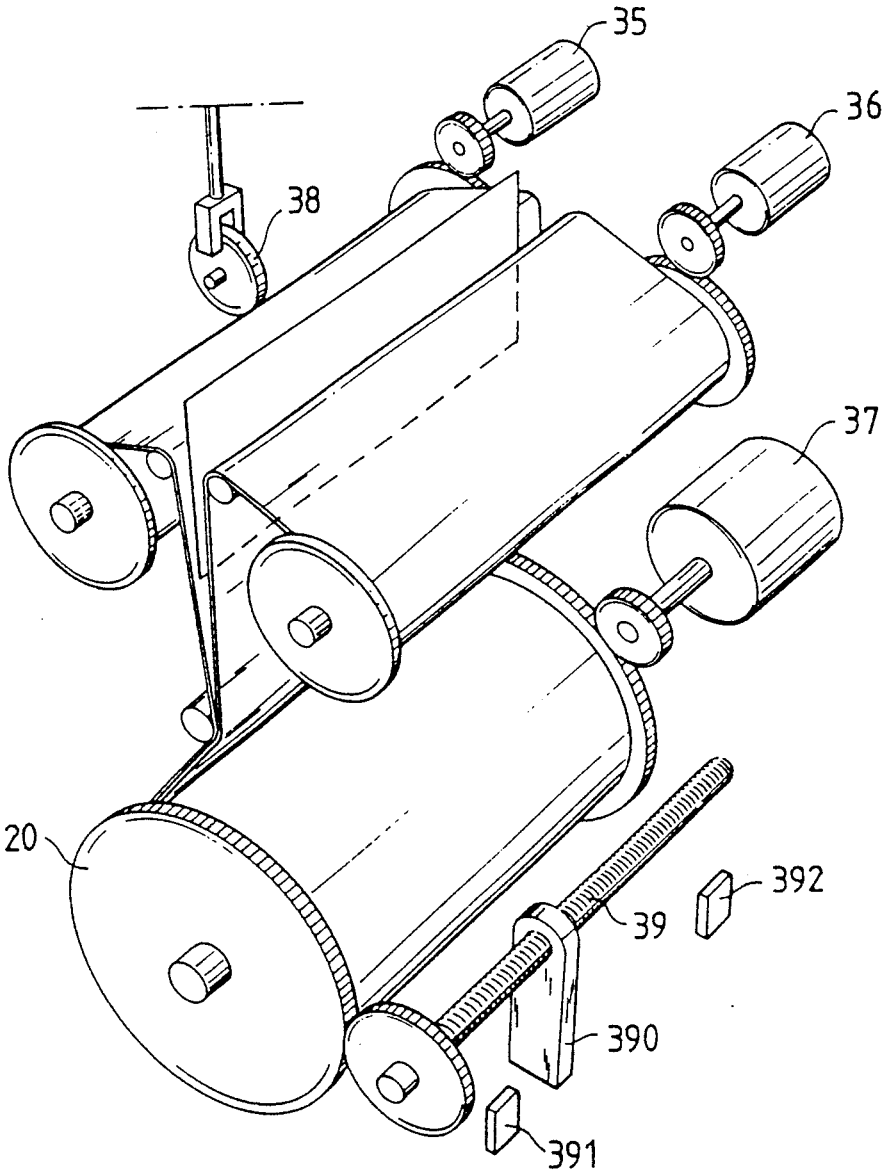
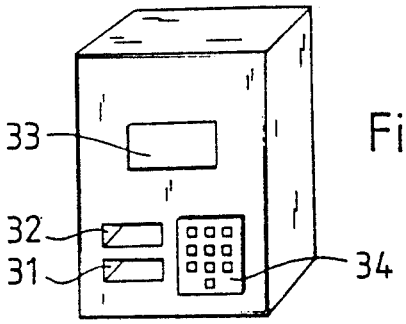
Fig. 3

ARRANGEMENT FOR DEPOSITING VALUABLE DOCUMENTS, SUCH AS BANK NOTES, CHEQUES

TECHNICAL FIELD

The present invention relates to an arrangement for the infeed of valuable documents, such as bank notes, cheques, and like documents, and more particularly, but not exclusively, to an arrangement for feeding valuable documents from a first opening of a plurality (at least two) openings to a second of said openings. The arrangement is of the kind which comprises command means located adjacent at least one opening of said openings and effective to control the operation of the arrangement externally thereof, and storage means for intermediate storage of valuable documents during document feed from one opening to another opening of said openings.

BACKGROUND ART

A bank note infeed and outfeed arrangement is known to the art from, for instance, Swedish Patent Specification 210179. This arrangement includes a belt which is wound onto two spools to a greater or lesser extent and which is intended for the temporary storage of bank notes during their passage into and out of the arrangement, via a common infeed and outfeed opening. A separate stripper or doctor means is mounted adjacent the infeed and outfeed opening and the belt to ensure correct feed of the bank notes.

This known arrangement, however, has a somewhat limited area of use and, despite the provision of the stripper means, is encumbered with certain drawbacks with respect to the risk of bank notes sticking to the belt during the outfeed sequence.

Another known arrangement for feeding bank notes, via an infeed opening, along a transport path to a storage space includes detector means operable to detect and control transportation of the bank notes within the arrangement, a plurality of separate storage chambers in the storage space, a collecting chamber, a second transport path extending from the correcting chamber to an outfeed opening, and command means. This known arrangement is described in detail in, for instance, U.S. Pat. No. 4,759,447, to which reference is made with regard to certain practical elements and components and with regard to solutions in connection with the specific storage means forming part of an inventive arrangement.

SUMMARY OF THE INVENTION

An arrangement constructed in accordance with the invention has a storage means which includes two mutually coacting belts, which together form a common third infeedand-outfeed opening for a series of valuable documents passing sequentially from one opening of said at least two openings to another opening and temporarily stored between the belts. The storage means is located in a pivotal housing which functions to cable the common opening of said storage means to be adjusted positionally in relation to one opening of said at least two openings in response to a command from said command means. Further characterizing features of the invention are defined in the subclaim.

BRIEF DESCRIPTION OF THE DRAWINGS

The invention will now be described in more detail with reference to the accompanying schematic drawings, in which

FIG. 2 illustrates the storage means of FIG. 1 in somewhat more detail; and

FIG. 3 illustrates the operational side of the arrangement.

PREFERRED EMBODIMENT

Figure 1:
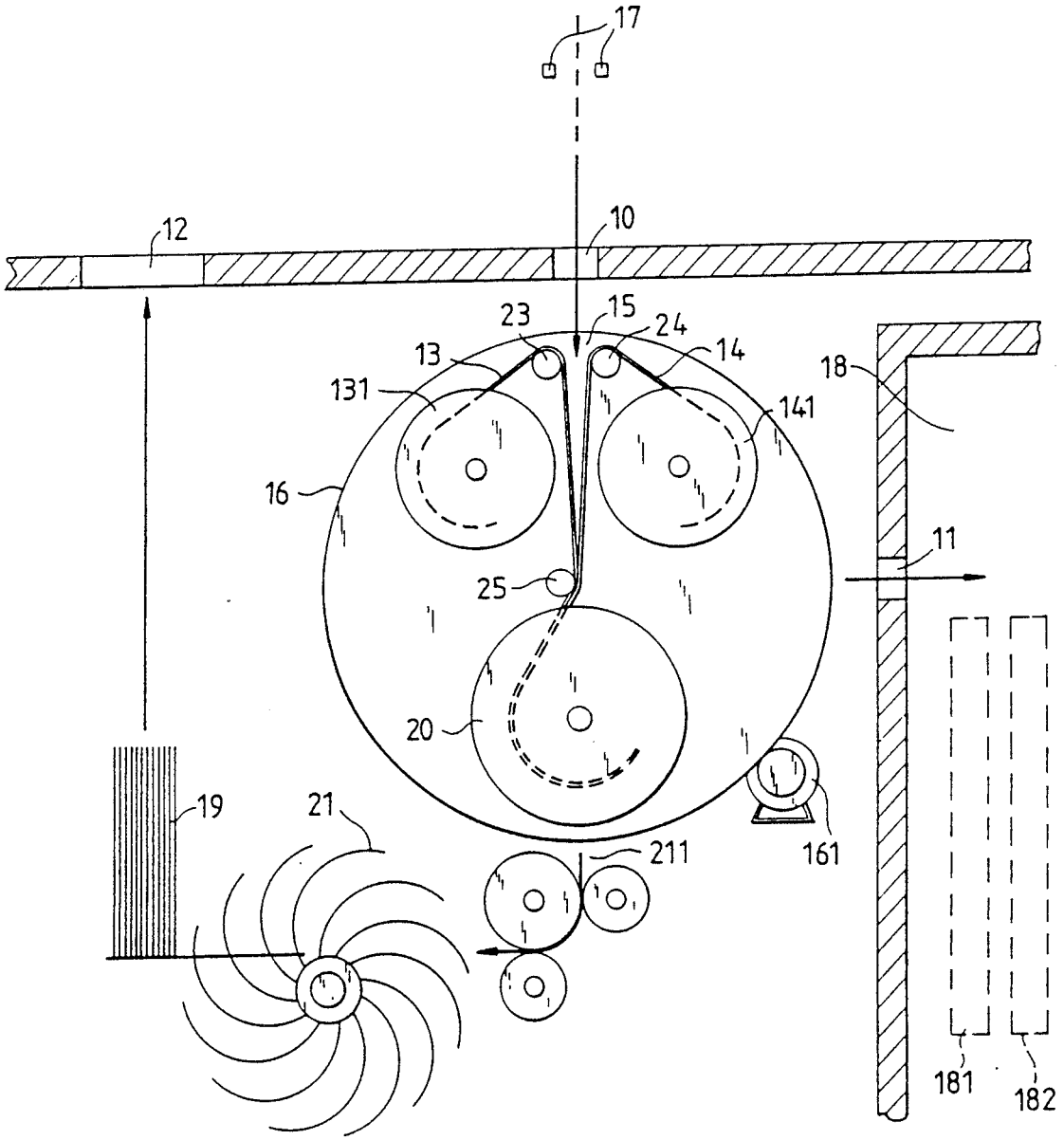
FIG. 1 illustrates a storage means utilized for an infeed-outfeed means having a return facility.

The storage means included in an inventive arrangement according to FIG. 1 comprises two mutually coacting belts 13, 14 which together define a common input and output opening 15, i.e. bank notes are fed both into and out of the opening defined by the belts 13, 14, in response to control signals from a command means 34, see FIG. 3. The belt 13 can be wound on and unwound from a belt reel 131, and the belt 14 can be wound on and unwound from a belt reel 141. The other ends of the belts 13, 14 are wound together on a common belt reel 20, and the belts run from respective reels 131, 141 to the reel 20 via individual guide rollers 23, 24 and a common guide roller 25. The guide rollers are positioned so that the belts 13, 14 extending between the reels 131, 141 and 20 will form a wedge-shaped opening which is intended to receive bank notes fed-in from an infeed opening 31, see FIG. 3.

The storage means 131-141-20 is located in a pivotal housing 16, such as to enable the input-output opening 15 of said storage to be positioned relative to one opening of a plurality of openings, namely an infeed opening 10, which is connected, through the intermediary of an internal (not shown) transport path, with the infeed opening 31 (see FIG. 3) available to customers externally of the arrangement, or with an infeed opening 11 leading to a storage space 18 incorporating separate chambers 181, 182, or with a refeed opening 212 leading to a refeed arrangement 21 for further transportation of bank notes to an outfeed or dispensing opening 32 (see FIG. 3) accessible externally to customers.

When a customer wishes to feed bank notes to the storage space 18, the customer activates/manipulates a command means 34 in a known manner (inserts the sum to be deposited, personal code, etc.), wherewith the housing 16 is pivoted so that the infeed-outfeed opening 15 will be directed towards the infeed opening 10, i.e. the opening from which bank notes are fed, one by one, in series and sequentially along a transport path from the infeed or deposit opening 31 accessible externally to the customer. Arranged along this transport path are detectors 17 which function to identify the type of bank note transported, the eventuality of double-feed, etc. As bank notes are transported, the belt reel 131 is rotated clockwise and the belt reel 141 anticlockwise, and the incoming bank notes are stored between the belts, which are wound onto the belt reel 20, which rotates in an anticlockwise direction. When the customer has initiated the feed process through the command means 34 and subsequently confirms that the infeed of bank notes shall take place, the housing 16 is rotated clockwise until the opening 15 is located opposite the opening 11 leading to the storage space 18, provided that no double-feed or forged bank note is detected. This rotation of the housing is indicated by means of a motor 161.

This intermediate storage of the bank notes will ensure that the mutual order and lateral position of the bank notes is maintained, which is a basic requirement for correct, further transportation of the bank notes into the storage space 18 and deposits of the bank notes into cassettes 181, 182.

Should the customer change his/her mind for some reason or other and wishes to retrieve the bank notes, the customer presses a "retrieve button" on the command means 34, which will then cause the housing to rotate so that the opening lies opposite the refeed opening 211 and the refeed means 21 is activated for transportation of the bank notes to a collecting chamber 19, in which the bank notes are bundled and then transported, in the form of a bundle, through an opening 12 to the outfeed or dispenser opening 32, see FIG. 3.

The process unit which controls the different series of facilities afforded by the arrangement is constructed so that if the detector 17 identifies a forged bank note or if the number or value of the bank notes fed into the arrangement does not coincide with the data punched into the arrangement by the customer, the housing 16 is rotated automatically to the position 211 and the bank notes are transported back to the customer terminal.

The inventive arrangement can be enlarged to include a plurality of terminals for the infeed/outfeed of bank notes to and from a common storage space 18 with the aid of a common storage means 131-141-20. In this case, the process unit includes a queuing-order means having stores for storage of information from the separate order devices and carrying out in sequence the orders or commands punched-in by the various customers.

The belts in the storage means are advanced through one "bank note space" (infeed path) at a time, and are accelerated by a wind-on motor 37 at the beginning of an infeed path and retarded by wind-off motors 35, 36 at the end of said infeed path. The correct length dimension of the infeed path is generated by a rotating wind-off sensor 38, the rotor of which has a peripheral length corresponding to one infeed path on the belts. Alternatively, an optosensor may be provided for reading a code printed on the belts, this code indicating the correct infeed distance. The infeed of bank notes takes place at a speed of about 10 bank notes per second, i.e. when depositing bank notes the motors are started and stopped about ten times per second. The dispensing of bank notes, on the other hand, occurs at a uniform rate. The infeed process is started by the leading edge of each bank note, which is detected by the means 17.

The belts should be well tensioned, so as not to lose grip on the bank notes. Consequently, the belts are held tensioned by respective wind-off motors 35, 36 during the time lapse between two consecutive bank notes, said motors herewith obtaining a reduced electric voltage, at the same time as the wind-on motor 37 is prevented from rotating by a back latch. The back latch is removed from its latching position with the aid of a magnet, prior to emptying the belts.

A transport screw 39 on which a nut 390 is moved proportionally to movement of the belts 13, 14 can be connected, e.g., to the belt reel 20. The nut 390 activates switches 391, 392 in the two end positions which correspond to the end positions of the belts 13, 14 (beginning and end), thereby guaranteeing that the belts will not be torn off.

In the following claims, the infeed opening 10 is referred to as a "first opening" and the infeed opening 11 as a "second opening".

We claim:

1. An arrangement for feeding valuable documents from a first opening (10) of at least two openings to at least as second opening (11) of said openings, comprising:

command means (34) located adjacent at least one of said openings and effective to control the functions of the arrangement externally thereof; and storage means for the intermediate storage of valuable documents while feeding valuable documents from the opening (31) to another opening (11) of said openings, characterized in that the storage means (131-141-20) includes two mutually coacting belts (13, 14), first and second belt reels (131, 141), each for individually winding and unwinding one of the two mutually coacting belts (13, 14), a common belt reel (20) for temporarily winding up both the belts (13, 14) together, and rollers for guiding the belts (13, 14) between the respective first and second belt reels (131, 141) and the common belt reel (20), which rollers are positioned for guiding the belts (13, 14) prior to being wound together onto the common belt reel (20) to form a common third infeed-and-outfeed opening (15) for receiving a series of valuable documents passing sequentially from one opening of said at least two openings for temporary storage of the documents between the two belts (13, 14); and in that the arrangement includes a pivotal housing (16) and the storage means (131-141-20) is located in the pivotal housing (16) which functions to enable the common opening (15) of said storage means to be adjusted positionally in relation to the selected one opening (11) of said at least two openings in response to a command from said command means (34).

2. An arrangement according to claim 1, characterized in that a sensing means (17) is located adjacent a transport path for the valuable documents, for sensing the type of the documents being fed and for sensing a double-feed condition of the valuable documents passing sequentially along said transport path, and in that positional adjustment of the common opening (15) of the storage means (131-141-20) in relation to one opening (11) of said at least two openings is intended to take place also in dependence on the sensing result of said sensing means (17).

3. An arrangement for feeding valuable documents from a first opening of the arrangement to a selected one of at least two second openings of the arrangement, comprising:

a housing, pivotally mounted for rotation;

a common belt reel mounted within the housing;

first and second lengths of belt disposed within the housing, a portion of each of the lengths being wound together and into contact with each other onto said common belt reel;

means for separately retaining said first and second lengths of belt prior to the portions of the lengths of belt being wound onto said common belt reel;

means for guiding each of said first and second lengths of belt between the separate retaining means and the common belt reel, and for positioning the first and second lengths of belt to form a third opening there between adjacent the common belt reel;

means for rotating the housing to position said third opening adjacent the first opening for receiving the valuable documents in gripping contact between the first and second lengths of belt in sequence prior to the lengths of belt wound onto the common belt reel for intermediate storage of the valuable documents in sequence between the lengths of belt, and for rotating the third opening to a selected one of the second openings for dispensing the valuable documents from the intermediate storage between the wound lengths of belt on the common belt reel.

4. An arrangement according to claim 3, wherein the means for separately retaining said first and second lengths of belt comprises first and second individual belt reels, said first and second belt reels rotatably mounted within the housing for winding and unwinding the respective lengths of belt.

5. An arrangement according to claim 4, wherein the means for guiding comprises first and second individual guide rollers and a common guide roller, the individual guide rollers and the common guide roller being positioned within the housing to dispose the first and second lengths of belt into a wedge-shaped path for forming the third opening.

* * * * *

UNITED STATES PATENT AND TRADEMARK OFFICE

CERTIFICATE OF CORRECTION

PATENT NO. : 5,064,074

DATED : November 12, 1991

INVENTOR(S) : Gosta Edin, Hans Zettergren

It is certified that error appears in the above-identified patent and that said Letters Patent is hereby corrected as shown below:

Column 1, Line 58, "third infeedand-outfeed opening for a series of valuable" should read --third infeed-and-outfeed opening for a series of valuable--

Column 4, Line 7, "least as second opening (11) of said openings, compris-" should read --least a second opening (11) of said openings, compris- --

Column 4, Line 14, "the opening (31) to another opening (11) of said" should read --one opening (31) to another opening (11) of said"

Signed and Sealed this

Twenty-third Day of February, 1993

*Attest:*

STEPHEN G. KUNIN

*Attesting Officer*

*Acting Commissioner of Patents and Trademarks*